US007128001B2

(12) United States Patent
Tsai

(10) Patent No.: US 7,128,001 B2
(45) Date of Patent: Oct. 31, 2006

(54) FOLDABLE TABLE

(75) Inventor: Frank Tsai, Taipei (TW)

(73) Assignee: Wok & Pan Ind., Inc., Guangdong (CN)

( * ) Notice: Subject to any disclaimer, the term of this patent is extended or adjusted under 35 U.S.C. 154(b) by 224 days.

(21) Appl. No.: 10/762,146

(22) Filed: Jan. 22, 2004

(65) Prior Publication Data

US 2005/0160951 A1 Jul. 28, 2005

(51) Int. Cl.
*A47B 3/00* (2006.01)

(52) U.S. Cl. ..... 108/130

(58) Field of Classification Search ..... 108/130, 108/129, 131, 132, 115, 127, 128, 125, 126, 108/116, 36, 123, 121, 35; 248/188, 188.1, 248/188.6, 115, 188.5, 439; 5/620
See application file for complete search history.

(56) References Cited

U.S. PATENT DOCUMENTS 329,734 A * 11/1885 Gosner ..... 473/15
1,757,260 A * 5/1930 Silverman ..... 108/132
2,223,068 A * 11/1940 Howe ..... 294/144
2,311,612 A * 2/1943 Pleiss ..... 248/439
2,828,173 A * 3/1958 Blink ..... 108/168
3,661,100 A * 5/1972 Tennant ..... 108/132
4,120,249 A * 10/1978 Blink et al. ..... 108/174
4,157,089 A * 6/1979 Loughrey ..... 606/245
4,864,941 A * 9/1989 Goulter ..... 108/132
5,004,029 A * 4/1991 Garner ..... 144/287
5,141,197 A * 8/1992 Mackaay ..... 248/439
5,392,718 A * 2/1995 Stevens ..... 108/167
5,660,121 A * 8/1997 Botts et al. ..... 108/132
5,678,491 A * 10/1997 Price et al. ..... 108/115
6,561,106 B1 * 5/2003 Tseng ..... 108/131
D480,580 S * 10/2003 Buono ..... D6/429

* cited by examiner

*Primary Examiner*—Janet M. Wilkens
*Assistant Examiner*—Timothy Ayres
(74) *Attorney, Agent, or Firm*—Raymond Y. Chan; David and Raymond Patent Firm

(57) ABSTRACT

A foldable table includes a tabletop and two leg frames for supporting the tabletop, each of the leg frames having a transverse member pivotally attached to a underside of the tabletop and a standing leg extended from the transverse member and pivotally moveable with respect to the tabletop. A retaining element having a first end pivotally attached to the transverse member and a second end pivotally attached to the standing leg of the other transverse member. The retaining element has an adjustable length adapted for lengthening to become longer than a distance between the transverse members of the leg frames as the leg frame is erected, thereby providing lateral support for the erected leg frame.

9 Claims, 5 Drawing Sheets

FOLDABLE TABLE

BACKGROUND OF THE PRESENT INVENTION

1. Field of Invention

The present invention relates to a foldable table, and more particularly to a foldable table having a light weight retaining mechanism for supporting the legs without damaging the structural integrity of the tabletop.

2. Description of Related Arts

Foldable tables are useful and convenient for individuals or a group of people in certain occasions. This is particularly true when the occasions are temporarily held in a place of limited space. A foldable table can be folded to minimize its occupying space and to stack as a pile, such that many can be stored in a small room. The foldable tables are of light weight, so that they can be easily carried to another room where they are unfolded for certain purposes. Due to the flexible configuration and light weight, foldable tables are often used for serving food or receiving attendants in a conference or banquet.

Foldable tables are suitable not only for indoor use, but also outdoor activities. A foldable table can be easily loaded in a truck or bigger-sized vehicles and transported to an outdoor place, such as a park and campground. The foldable table can be then erected for various purposes. For example, in a rescue action of emergency, a working table may be needed for placing tools or paper works.

Conventionally, a foldable table includes a tabletop, table legs pivotally attached to the underside of the tabletop, and retaining elements for supporting and maintaining the table legs in an erected manner. The tabletop can be found as in various shapes, such as round, triangle, rectangle and polygonal, among which rectangle is the most-often-seen shape of tabletop. The table legs are so attached to the underside of the tabletop that its mass center falls in the inner area defined by the table legs for keeping the tabletop in balance thereon. The table legs are capable of pivotally moving about the tabletop, such that they may be folded under the tabletop and unfolded to an erected position. The retaining elements have certain mechanism that is able to hold the erected table legs in place and prevent them from folding back causing the tabletop collapsed.

Much attention has been directed to improvement of the retaining elements. One conventional design may be found in U.S. Pat. No. 6,032,585 entitled "Folding Banquet Table," issued to Daniel R. Pinch on Mar. 7, 2000, wherein a support strut is pivotally attached to a cross member of leg with its one end and sidably mounted to a channel member of the tabletop with its another end, such that the erected leg, support strut and the tabletop constitute a triangle that keeps the erected leg in its position.

A drawback of the above-mentioned type of foldable table is that the channel member may adversely affect the structural integrity of the tabletop. The channel member is mounted to the tabletop by means of bolts or screws drilled into the central portion of its underside. Usually, the central portion of the tabletop is most susceptible to downward deformation, especially for the areas drilled of bolts and screws because of the concentration of stress. Moreover, this type of foldable table requires an additional part, i.e. the channel member, for assembling the support strut, therefore complicating the manufacturing process and incurring an additional cost.

Another conventional design of the retaining element may be found in U.S. Pat. No. 6,112,674 entitled "Portable Folding Utility Table with Center Support Assembly," issued to Carl R. Stanford on Sep. 5, 2000, wherein a pair of support pedestals are pivotally attached to a frame, through the middle of which a cross-brace member runs, and a pair of pivotal support braces foldably and pivotally connect the cross-brace member and support pedestals, respectively, in order to maintain the support pedestals in an erected position. In this patent, the support pedestals, cross-brace member and pivotal support braces are assembled with the frame as a unit apart from the tabletop, such that the number of bolts and screws sued on the tabletop can be reduced for keeping its structural integrity.

A shortcoming of the above type of foldable table is its heaviness. In order to avoid having bolts and screws drilled on the underside of the tabletop, it adopts a cross-brace member running through the middle of the frame to which the pivotal support brace is pivotally attached. The cross-brace member is made of rigid material to support the weight of the tabletop in the middle portion. Thus, the cross-brace member adds additional weight to the foldable and reduces its mobility.

As such, what is needed is a foldable table that has retaining mechanism adapted for keeping the table legs in an erected position, without substantially adding weight to the foldable table and substantially avoiding adversely affecting the structural integrity of the tabletop.

SUMMARY OF THE PRESENT INVENTION

A main object of the present invention is to provide a foldable table that includes a retaining element having a first end pivotally attached to a transverse member of a leg frame and a second end pivotally attached to a standing leg of an opposite leg frame, wherein as the leg frames are erected, the retaining element is adjusted to become longer than the longitudinal distance between two opposite leg frames for laterally supporting the leg frame in an erected position.

Another object of the present invention is to provide a foldable table that includes a retaining element having a first end pivotally attached to a transverse member of a leg frame and a second end pivotally attached to a standing leg of an opposite leg frame, wherein as the leg frames are erected, the retaining element is adjusted to become longer than the longitudinal distance between two opposite leg frames, such that the standing leg of the erected leg frame is supported, without having a cross-brace member running across the middle portion of the foldable table for providing basis of attachment for the retaining element, whereby reducing the weight of the foldable table.

Another object of the present invention is to provide a foldable table that includes a retaining element having a first end pivotally attached to a transverse member of a leg frame and a second end pivotally attached to a standing leg of an opposite leg frame, wherein as the leg frames are erected, the retaining element is adjusted to become longer than the longitudinal distance between two opposite leg frames, such that the standing leg of the erected leg frame is supported, without having the retaining element directly attached to the underside of the tabletop, thereby preserving the structural integrity thereof.

Accordingly, in order to accomplish the above objects, the present invention provides a foldable table, comprising a tabletop, two leg frames for supporting the tabletop, and two retaining frames coupling between the two leg frames.

Each of the leg frames comprises a transverse member pivotally attached to a bottom side of the tabletop along a transverse edge portion thereof, two standing legs spacedly extended from the transverse member, and a reinforcing arm extended from the transverse member to one of the standing legs, such that the leg frames are adapted to pivotally fold between an unfolded position and a folded position, wherein at the unfolded position, the standing legs are perpendicularly extended from the tabletop, and at the folded position, the standing legs are rested on the bottom side of the tabletop.

Each of the retaining frames comprises a retaining arm having a first end pivotally attached to the reinforcing arm of one of the leg frames and a second end pivotally attached to the transverse member of another leg frame, wherein each of the retaining arms has an adjustable control length defining between the first and second ends arranged in such a manner that when each of the leg frames is outwardly folded from the tabletop, the control length of each of the retaining arms is lengthened to retain the respective leg frame at the unfolded position, and when each of the leg frames is inwardly folded to the folded position, the control length of each of the retaining arms is reduced to allow the respective leg frame to rest on the tabletop.

These and other objectives, features, and advantages of the present invention will become apparent from the following detailed description, the accompanying drawings, and the appended claims.

DETAILED DESCRIPTION OF THE PREFERRED EMBODIMENT

Figure 1:
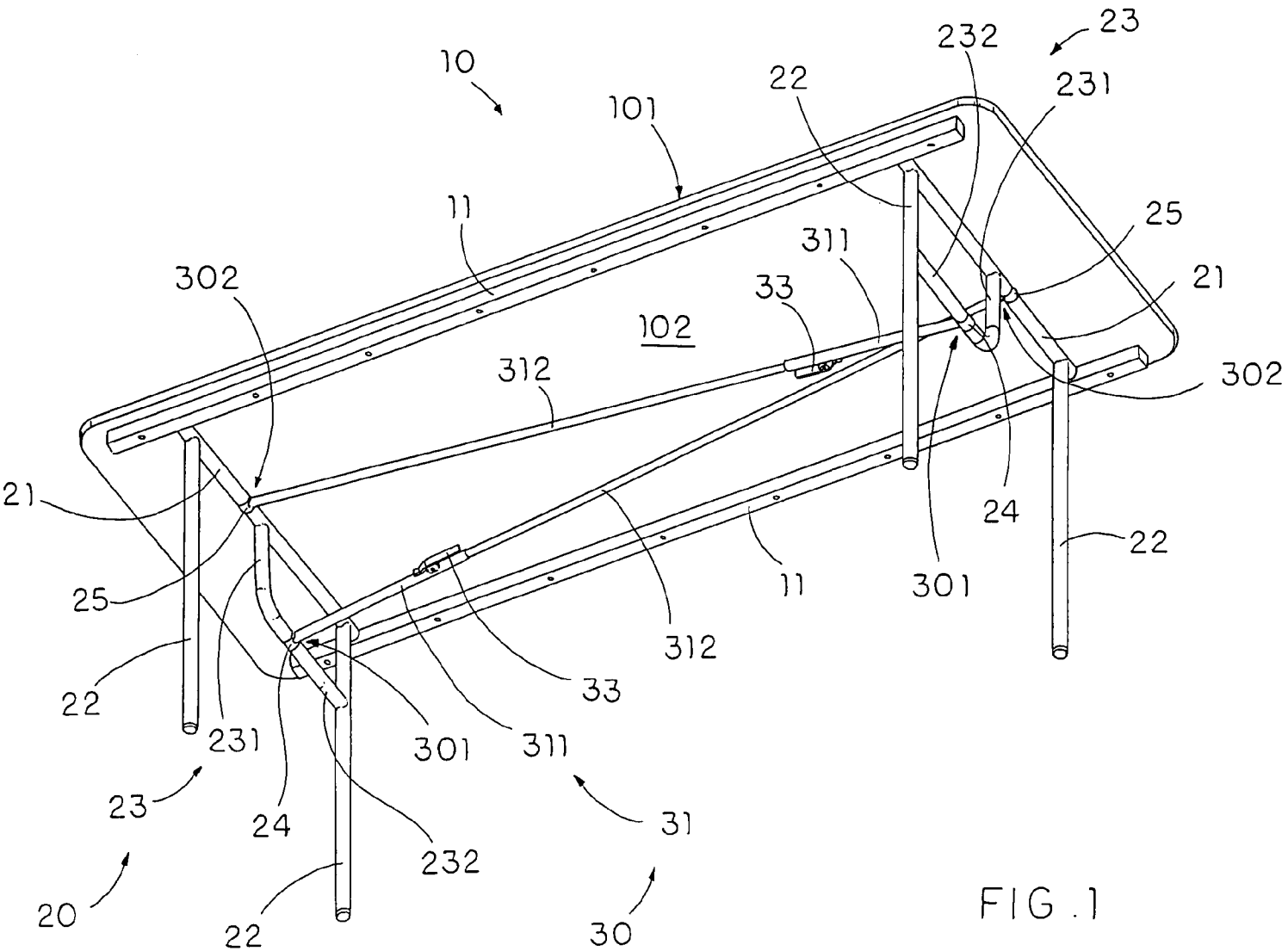
FIG. 1 is a perspective view of a foldable table according to a first preferred embodiment of the present invention.
Figure 2:
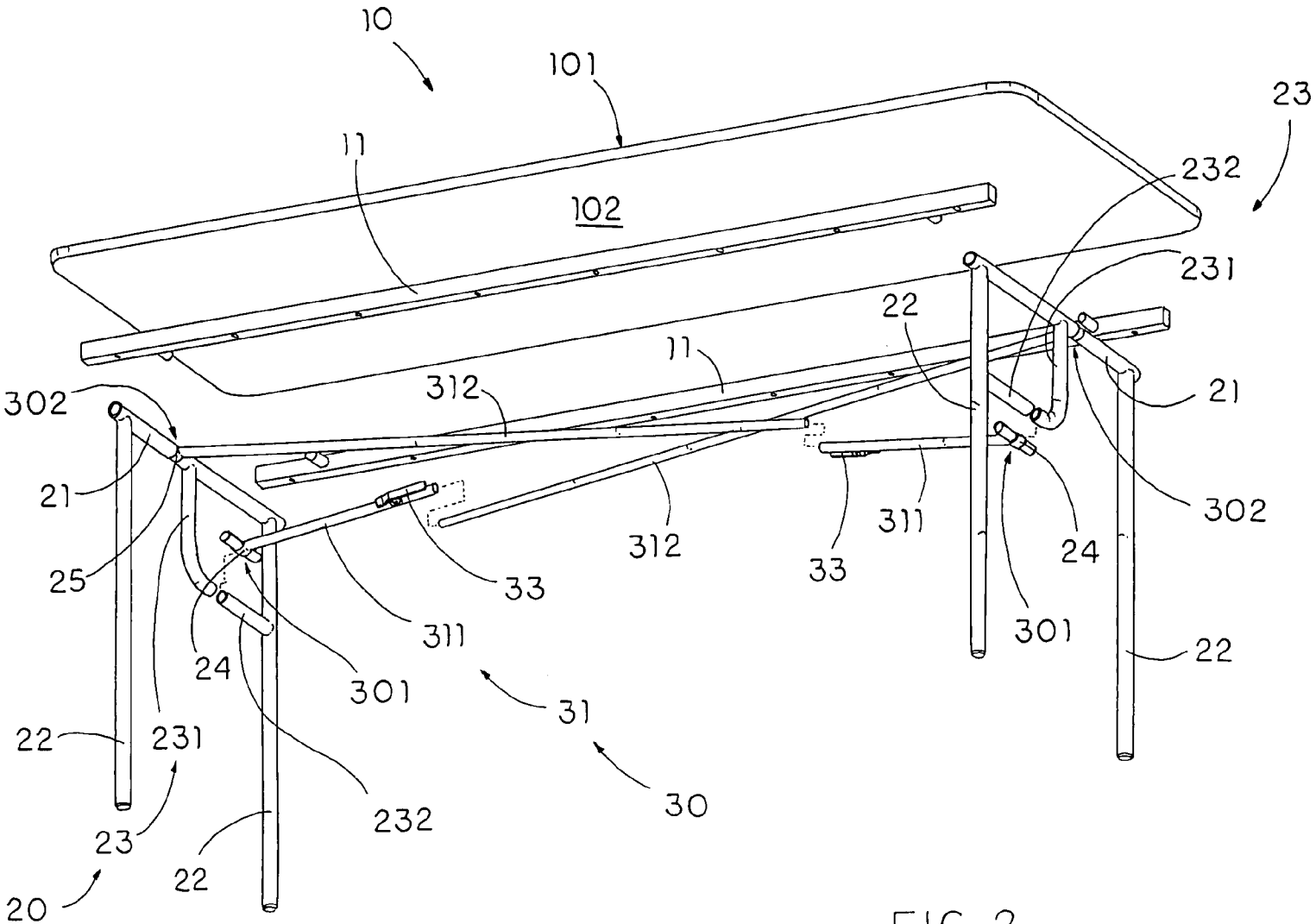
FIG. 2 is an exploded view of the foldable table according to the above first preferred embodiment of the present invention.

Referring to FIGS. 1 and 2 of the drawings, a foldable table according to a first embodiment of the present invention is illustrated, wherein the foldable table comprises a tabletop 10, two leg frames 20 for supporting the tabletop 10, and two retaining frames 30 coupling between the two leg frames 20.

Each of the leg frames 20 comprises a transverse member 21 pivotally mounted to a bottom side of the tabletop 10 along a transverse edge portion thereof, two standing legs 22 spacedly extended from the transverse member 21, and a reinforcing arm 23 extended from the transverse member 21 to one of the standing legs 22, such that the leg frames 20 are adapted to pivotally fold between an unfolded position and a folded position, wherein at the unfolded position, the standing legs 22 are perpendicularly extended from the tabletop 10, and at the folded position, the standing legs 22 are rested on the bottom side of the tabletop 10.

Figure 3:
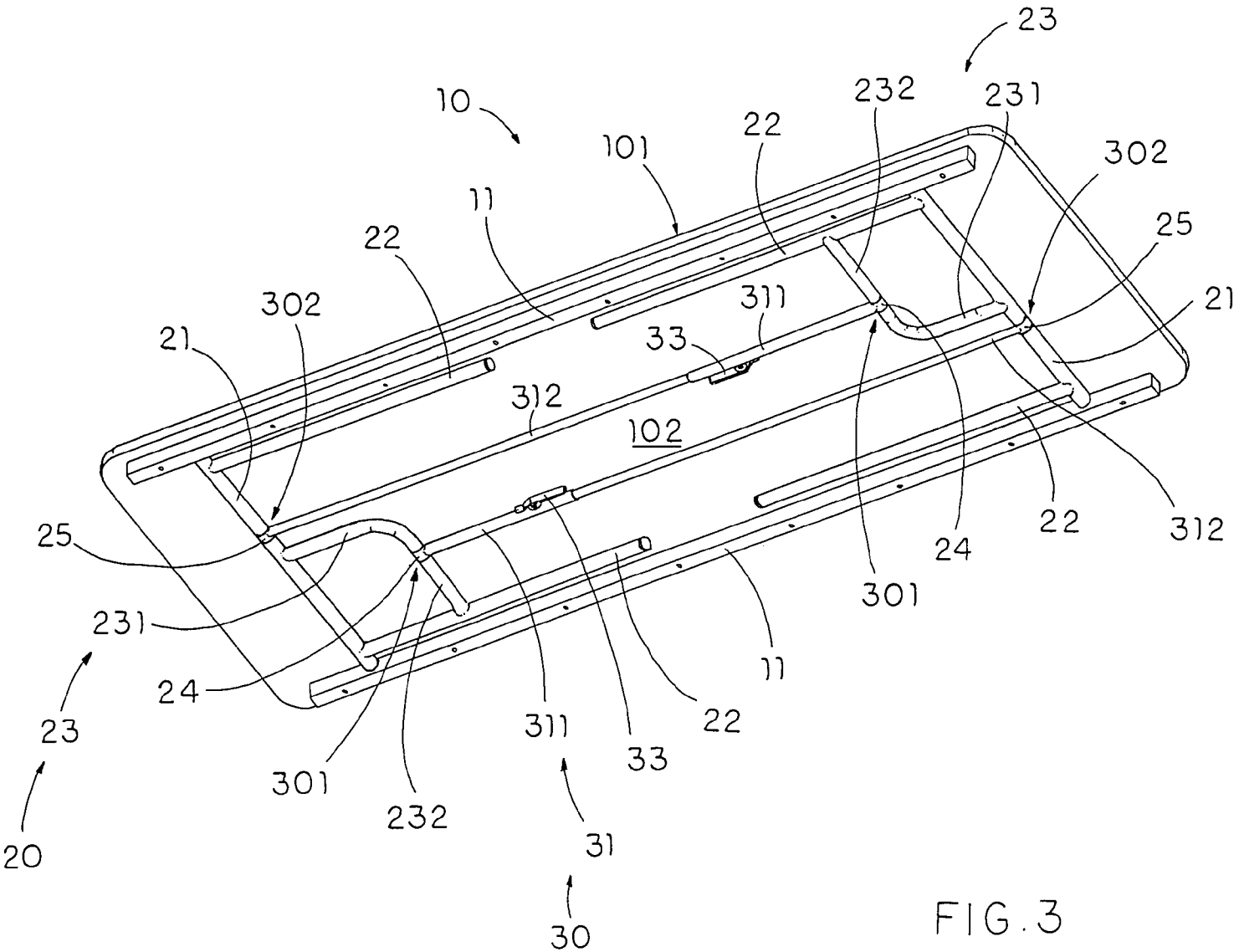
FIG. 3 is a perspective view of the foldable table in a folded position according to the above first preferred embodiment of the present invention.

Each of the retaining frames 30 comprises a retaining arm 31 having a first end 301 pivotally attached to the reinforcing arm 23 of one of the leg frames 20 and a second end 302 pivotally attached to the transverse member 21 of another leg frame 20, wherein each of the retaining arms 31 has an adjustable control length defining between the first and second ends 301, 302 arranged in such a manner that when each of the leg frames 20 is outwardly folded from the tabletop 10, the control length of each of the retaining arms 31 is lengthened to retain the respective leg frame 20 at the unfolded position, and when each of the leg frames 20 is inwardly folded to the folded position, the control length of each of the retaining arms 31 is reduced to allow the respective leg frame 20 to rest on the tabletop 10, as shown in FIG. 3.

According to the preferred embodiment, the tabletop 10 has an upside 101 for serving utility functions and an underside 102 as the bottom side, to which the leg frames 20 are attached thereon. The tabletop 10 may be made in various shapes, such as triangle, rectangle and round. Accordingly, the leg frames 20 are pivotally attached to the two far transverse ends of the tabletop 10, facing one another. The tabletop 10 is made of rigid material for structural stiffness and sturdiness, and also in consideration of the weight. The goal is to have the tabletop 10 as stiff and light as possible. Among the candidates of suitable materials, wood, steel, plastic and composite materials are the popular ones.

The tabletop 10 further comprises two side supports 11 are longitudinally mounted along two longitudinal edge portions of the tabletop 10 at the underside 102 thereof by bolts or screws, wherein the transverse members 21 of the leg frames 20 are pivotally mounted between the two side supports 11 along the two transverse edge portions of the tabletop 10 respectively. The side supports 11 are made of materials stiffer than the tabletop 10 in order to strengthen its structure, particularly to avoid the tabletop 10 from bending downwardly at its middle portion. It is preferably that the side supports 11 are made as hollow steel bars for balancing the structural strength and the weight.

As shown in FIGS. 1 and 2, each of the retaining arms 31 comprises a tubular first arm member 311 and a tubular second arm member 312 which has a diameter slightly smaller than a diameter of the first arm member 311 and is slidably and coaxially inserted into the first arm member 311 to selectively adjust the control length between the first and second ends 301, 302 of the respective retaining arm 31, so as to guide the respective leg frame 20 between the folded position and the unfolded position.

The first arm member 311 defines the first end 301 of the retaining arm 31 to pivotally connect to the reinforcing arm 23 of the respective leg frame 20 while the second member 312 defines the second end 302 of the retaining arm 31 to pivotally connect to the transverse member 21 of the other leg frame 20. Therefore, when the leg frame 20 is folded to rest on the underside 102 of the tabletop 10, i.e. the folded position, the second arm member 312 is coaxially and inwardly slid into the first arm member 311 to reduce the control length between the first and second ends 301, 302 of the respective retaining arm 31. In other words, when the leg frame 20 is folded to perpendicularly extended from the tabletop 10, i.e. the unfolded position, the second arm member 312 is coaxially and outwardly slid from the first arm member 311 to increase the control length between the first and second ends 301, 302 of the respective retaining arm 31.

Accordingly, each of the retaining frames 30 further comprises an arm locker 33 provided at the first arm member 311 to lock up the first arm member 311 with the second arm member 312 so as to retain the control length between the first and second ends 301, 302 of the respective retaining arm 31 at the unfolded position.

The arm locker 33 is rotatably engaged with the first arm member 311 to lock with the second arm member 312 wherein the arm locker 33 is positioned at the first arm member 311 where the first and second arm members 311, 312 overlaps. The control length of the retaining arm 31 can be adjusted to a releasing position that the first arm member 311 and the second arm member 312 can move relatively, and a locking position that the first arm member 311 and the second arm member 312 are fixed and cannot move relatively.

In other words, when the leg frame 20 is pivotally folded to the unfolded position, the reinforcing arm 23 pivotally moves about the transverse member 21 away from the underside 102 of the tabletop 10, such that the reinforcing arm 23 pulls the first arm member 311 away from the second arm member 312 to lengthen the control length of the respective retaining arm 31. Once the leg frame 20 is erected to the unfolded position, the arm locker 33 is adjusted to the locking position to lock up the first arm member 311 and the second arm member 312 together. At this point, the lengthened retaining arm 31 is longer than the distance between the two transverse members 21, so that the retaining arm 31, the reinforcing arm 23 and the tabletop 10 constitute a triangular structure supporting the leg frame 20 at the unfolded position.

According to the preferred embodiment, each of the reinforcing arms 23, having a L-shaped, has a longitudinal portion 231 extended from the transverse member 21 and a transverse portion 232 extended from the corresponding standing leg 22, so as to strengthen the respective leg frame 20. Accordingly, the first ends 301 of the retaining arms 31 are pivotally connected to the longitudinal portions 231 of the reinforcing arms 23 respectively.

As shown in FIG. 2, two pivotal joints 24, 25 are needed for attachment of the first and second ends 301, 302 of the retaining arm 31 to the reinforcing arm 23 and the transverse member 21 respectively. Each of the pivotal joints 24, 25, having a T-shaped, has three ends that when two corresponding axle ends are rotatably connected, the third pivot end is adapted to move in pivotal manner.

The longitudinal portion 231 of each of the reinforcing arm 31 is constructed to have a cornering section and a longitudinal section, wherein two corresponding axle ends of the first pivot joint 24 are rotatably mounted to the cornering section and the longitudinal section respectively while the pivot end is mounted to the first end 301 of the reinforcing arm 31 so that the axle of the first pivotal joint 24 can be fitted into between two sections of the longitudinal portion 231 of the reinforcing arm 31 in a rotatably movable manner. Likewise, the transverse member 21 is constructed to have two side sections wherein the two corresponding axle ends of the second pivot joint 25 are rotatably mounted to the two side sections respectively while the pivot end is mounted to the second end 302 of the reinforcing arm 31 so that the axle of the second pivotal joint 25 can be fitted into between two side sections of the transverse member in a rotatably movable manner. As a result, the retaining arm 31 may pivotally rotate about the reinforcing arm 23, whereby when the leg frame 20 is folding or unfolding, the first pivotal joint 24 and second pivotal joint 25 rotate accordingly to enable the first arm member 311 and the second arm member 312 of the retaining arm 31 relatively.

As shown in FIG. 3, the two retaining arms 31, which are extended in a parallel manner, are pivotally interlocked between the two leg frames 20 at a position along a mid-longitudinal portion of the tabletop 10. The advantage of the retaining arms 31 disposed at,the mid-longitudinal portion of the tabletop 10 is to effectively enhance the strength of the tabletop 10 by evenly distributing a downward loading force on the upside 101 of the tabletop 10 to the leg frames 20 through the retaining arms 31. The invention also has the advantage of the reducing the weight by eliminating the adoption of cross-brace member running across the middle portion of the underside 102 of the tabletop 10. It also helps to keep the structural integrity by avoiding having the retaining frames 30 affixed to the underside 102 of the tabletop 10, thereby save the same from bolts and screws drilled thereon and preserve the structural integrity of the tabletop 10 and reduces the risk that the tabletop 10 cracks along the drilled holes.

Figure 4:
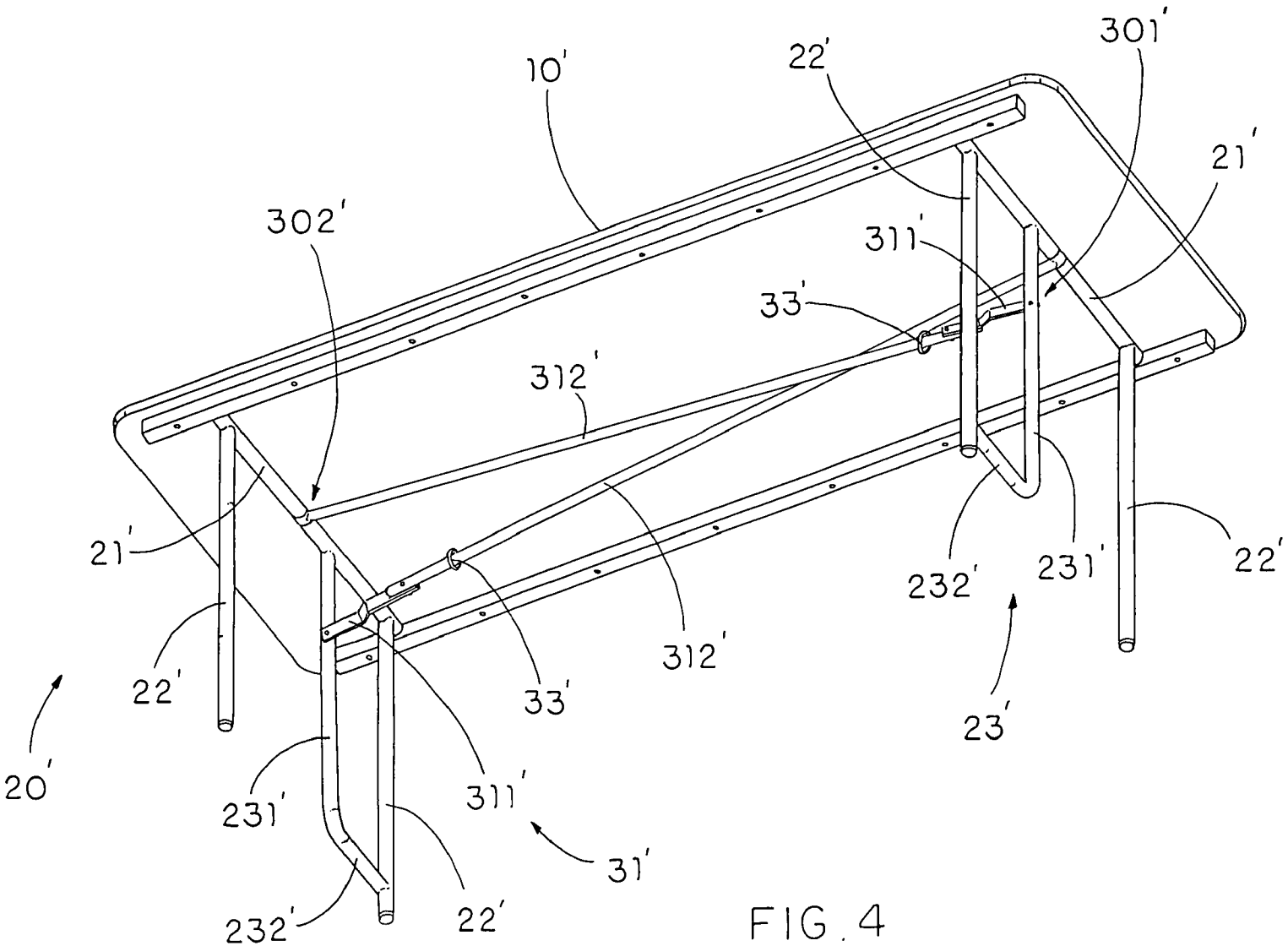
FIG. 4 is a perspective view of a foldable table according to a second preferred embodiment of the present invention.

As shown in FIG. 4, a foldable table of a second embodiment illustrates an alternative mode of the first embodiment of the present invention, wherein the foldable table of the second embodiment, which basically shows a modification of the first embodiment, comprises a tabletop 10', two leg frames 20' for supporting the tabletop 10', and two retaining frames 30' coupling between the two leg frames 20'.

Each of the leg frames 20' comprises a transverse member 21' pivotally mounted to a bottom side of the tabletop 10 along a transverse edge portion thereof, two standing legs 22' spacedly extended from the transverse member 21', and a reinforcing arm 23' extended from the transverse member 21' to one of the standing legs 22', such that the leg frames 20' are adapted to pivotally fold between an unfolded position and a folded position, wherein at the unfolded position, the standing legs 22' are perpendicularly extended from the tabletop 10', and at the folded position, the standing legs 22' are rested on the bottom side of the tabletop 10'.

Figure 5:
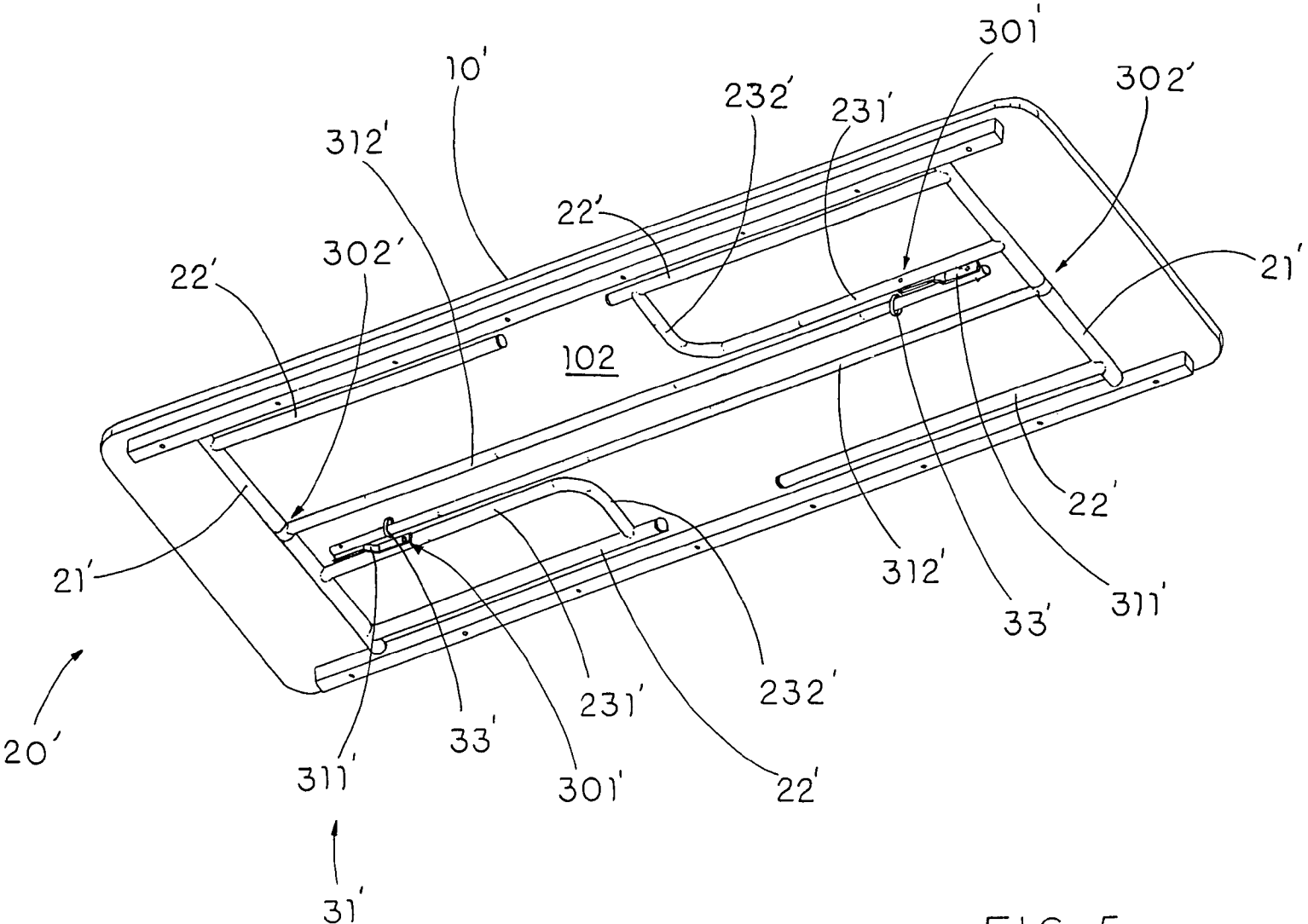
FIG. 5 is a perspective view of the foldable table in a folded position according to the above second preferred embodiment of the present invention.

Each of the retaining frames 30' comprises a retaining arm 31' having a first end 301' pivotally attached to the reinforcing arm 23' of one of the leg frames 20' and a second end 302' pivotally attached to the transverse member 21' of another leg frame 20', wherein each of the retaining arms 31' has an adjustable control length defining between the first and second ends 301', 302' arranged in such a manner that when each of the leg frames 20' is outwardly folded from the tabletop 10', the control length of each of the retaining arms 31' is lengthened to retain the respective leg frame 20' at the unfolded position, and when each of the leg frames 20' is inwardly folded to the folded position, the control length of each of the retaining arms 31' is reduced to allow the respective leg frame 20' to rest on the tabletop 10', as shown in FIG. 5.

As shown in FIG. 4, each of the retaining arms 31' comprises a first arm member 311' defining the first end 301' to pivotally connect with the reinforcing arm 23' of the respective leg frame 20 and a second arm member 312' defining the second end 302' to pivotally connect with the transverse member 21' of the other leg frame 20', wherein the first arm member 311' is pivotally connected to the second arm member 312' such that the first arm member 311' is pivotally folded to overlap with the second arm member 312' to reduce the control length of the respective retaining arm 31' while the first arm member 311' is pivotally folded to align with the second arm member 312' to extend the control length between the first and second ends 301', 302' of the respective retaining arm 31'.

Each of the retaining frames 31' further comprises an arm locker 33', having a ring shaped, slidably mounted along the second arm member 312' to lock up the first arm member 311' with the second arm member 312' in a pivot manner so as to retain the control length between the first and second ends 301', 302' of the respective retaining arm 31' at the unfolded position.

In addition, the two retaining arms 31', which are extended in a parallel manner, are pivotally interlocked between the two leg frames 20' at a position along a mid-longitudinal portion of the tabletop 10', as shown in FIG. 5, to effectively enhance the strength of the tabletop 10' by evenly distributing a downward loading force on the tabletop 10' to the leg frames 20' through the retaining arms 31'.

Each of the reinforcing arms 23', having a L-shaped, has a longitudinal portion 231' extended from the transverse member 21' and a transverse portion 232' extended from the corresponding standing leg 22', so as to strengthen the respective leg frame 20'. Accordingly, the first ends 301' of the retaining arms 31' are pivotally connected to the transverse portions 232' of the reinforcing arms 23' respectively.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable table, comprising:

a tabletop;

a pair of leg frames for supporting said tabletop, each of said leg frames comprising a transverse member pivotally mounted to a bottom side of said tabletop along a transverse edge portion thereof, two standing legs spacedly extended from said transverse member, and a L-shaped reinforcing arm having a longitudinal portion extended from said transverse member and a transverse portion extended from one of said standing leg, such that said leg frames are adapted to pivotally fold between an unfolded position and a folded position, wherein at said unfolded position, said standing legs are perpendicularly extended from said tabletop, and at said folded position, said standing legs are rested on said bottom side of said tabletop; and a pair of retaining frames coupling between said two leg frames, wherein each of said retaining frames comprises a retaining arm having a first end pivotally attached to said transverse portion of said reinforcing arm of one of said leg frames and a second end pivotally attached to said transverse member of another said leg frame, wherein each of said retaining arms has an adjustable control length defining between said first and second ends configured when each of said leg frames is outwardly folded from said tabletop, said control length of each of said retaining arms is lengthened to retain said respective leg frame at said unfolded position, and when each of said leg frames is inwardly folded to said folded position, said control length of each of said retaining arms is reduced to allow said respective leg frame to rest on said tabletop.

2. The foldable table, as recited in claim 1, wherein said two retaining arms are pivotally extended between said two leg frames at a position along a mid-longitudinal portion of said tabletop, wherein said two retaining arms are extended in a parallel manner to rest underneath said tabletop when said leg frames are pivotally folded at said folded position.

3. The foldable table, as recited in claim 1, wherein each of said retaining arms comprises a tubular first arm member and a tubular second arm member which has a diameter slightly smaller than a diameter of said first arm member and is slidably and coaxially inserted into said first arm member to selectively adjust said control length between said first and second ends of said retaining arm, so as to guide said respective leg frame between said folded position and said unfolded position.

4. The foldable table, as recited in claim 2, wherein each of said retaining arms comprises a tubular first arm member and a tubular second arm member which has a diameter slightly smaller than a diameter of said first arm member and is slidably and coaxially inserted into said first arm member to selectively adjust said control length between said first and second ends of said retaining arm, so as to guide said respective leg frame between said folded position and said unfolded position.

5. The foldable table, as recited in claim 3, wherein each of said retaining frames further comprises an arm locker provided at said first arm member to lock up said first arm member with said second arm member so as to retain said control length between said first and second ends of said respective retaining arm at said unfolded position.

6. The foldable table, as recited in claim 4, wherein each of said retaining frames further comprises an arm locker provided at said first arm member to lock up said first arm member with said second arm member so as to retain said control length between said first and second ends of said respective retaining arm at said unfolded position.

7. The foldable table, as recited in claim 1, wherein said tabletop comprises two side supports longitudinally mounted along two longitudinal edge portions of said tabletop, wherein said transverse members of said leg frames are pivotally mounted between said two side supports along said two transverse edge portions of said tabletop respectively.

8. The foldable table, as recited in claim 6, wherein said tabletop comprises two side supports longitudinally mounted along two longitudinal edge portions of said tabletop, wherein said transverse members of said leg frames are pivotally mounted between said two side supports along said two transverse edge portions of said tabletop respectively.

9. The foldable table, as recited in claim 1, wherein said first ends of said retaining arms are pivotally coupled with said transverse portions of said reinforcing arms via two pivotal joints respectively, wherein each of said pivotal joints, having a T-shape, has two corresponding axle ends rotatably coupling along said respective transverse portion of said reinforcing arm and a pivot end extended to said first end of said retaining arm.

* * * * *